US007037245B2

(12) United States Patent
Burwell

(10) Patent No.: US 7,037,245 B2
(45) **Date of Patent: *May 2, 2006**

(54) WEIGHT EXERCISE APPARATUS

(75) Inventor: Jerry J. Burwell, Cardiff, CA (US)

(73) Assignee: HT&R Sports, LLC, Cardiff, CA (US)

( * ) Notice: Subject to any disclaimer, the term of this patent is extended or adjusted under 35 U.S.C. 154(b) by 62 days.

This patent is subject to a terminal disclaimer.

(21) Appl. No.: 10/830,524

(22) Filed: Apr. 22, 2004

(65) Prior Publication Data

US 2004/0209747 A1 Oct. 21, 2004

Related U.S. Application Data

(63) Continuation of application No. 10/039,217, filed on Jan. 3, 2002, now Pat. No. 6,776,741.

(51) Int. Cl.
*A63B 21/072* (2006.01)

(52) U.S. Cl. ..... 482/108; 482/106; 482/107

(58) Field of Classification Search ..... 482/93–98, 482/106–108; 21/680–683, 49–50, 105
See application file for complete search history.

(56) References Cited

U.S. PATENT DOCUMENTS 4,076,236 A * 2/1978 Ionel ..... 482/108
4,453,710 A * 6/1984 Plotz ..... 482/107
4,529,197 A * 7/1985 Gogarty ..... 482/107
4,566,690 A * 1/1986 Schook ..... 482/108
4,638,994 A * 1/1987 Gogarty ..... 482/107
4,913,422 A * 4/1990 Elmore et al. ..... 482/106
5,024,434 A * 6/1991 Smith ..... 482/107
5,090,693 A * 2/1992 Liang ..... 482/108
5,222,930 A * 6/1993 Bold, Jr. ..... 482/132
5,464,379 A * 11/1995 Zarecky ..... 482/108
5,628,716 A * 5/1997 Brice ..... 482/106
5,871,423 A * 2/1999 Pruchnik ..... 482/110
5,911,651 A * 6/1999 Liu ..... 482/108

* cited by examiner

*Primary Examiner*—Stephen K. Cronin
*Assistant Examiner*—Fenn C. Mathew
(74) *Attorney, Agent, or Firm*—Gordon & Rees LLP

(57) ABSTRACT

An improved weight exercise apparatus having an interlocking grip bar and rotationally removable weight plates. A weight plate is attached to a socket on the grip bar and can be interlocked with additional weight plates using a simple insert and twist motion. The grip bar does not extend beyond the attached weight plates making the apparatus ergonomically friendly and aesthetically pleasing. The invention restricts the movement of interlocked weight plates to limit rattle-type noise typical of loose weights on a barbell and includes a latching mechanism to prevent a weight plate from being accidentally disconnected.

18 Claims, 8 Drawing Sheets

WEIGHT EXERCISE APPARATUS

CROSS REFERENCE TO RELATED APPLICATIONS

This application is a continuation of application Ser. No. 10/039,217 filed Jan. 3, 2002 now U.S. Pat. No. 6,776,741.

FIELD OF THE INVENTION

The present invention relates to an adjustable weight apparatus with modular interlocking components.

BACKGROUND OF THE INVENTION

The practice of exercising with weights is well known, and is commonly used to increase the strength and tone of muscles in the body. As such, the fitness equipment market has a preponderance of barbells, dumbbells, and other types of weight resistance equipment.

When exercising with weights, it is often desirable to change the amount of weight being used during an exercise program. A variety of fixed weight equipment is available, but a suitable selection of such equipment requires a lot of room for use and takes a good deal of space for storage.

Adjustable weight equipment is also available where weights may be added or removed from an apparatus. The process for changing weights, however, is often complicated and time consuming. For example, as described in U.S. Pat. No. 4,529,197, weight changes are made by removing and replacing a protruding locking collar on a grip bar each time weights are added or removed. In addition to being time consuming, the procedure may require a special tool, and can be difficult to implement.

In other types of adjustable equipment, weights are changed using a threaded connector as described, for example, in U.S. Pat. No. 5,464,379. Threaded connectors have several disadvantages. They may bind, become difficult to remove, and require tightening, which is dependent on the strength of the user. In addition, the weights may become loose during an exercise and may even dislodge from the bar member, causing distraction or injury.

Some types of apparatus have the bar or grip of a barbell or dumbbell extending beyond the weight plates, creating equipment that is larger than necessary and tending to restrict the full movement of wrists and arms.

In addition, most weight exercise equipment is fabricated primarily with metal parts, which tends to increase the manufacturing cost and the final cost to the consumer.

Accordingly, there is a need to provide an improved adjustable weight exercise apparatus that is functional, easy to use, safe from accidental disconnects, ergonomically friendly, and cost-effective.

BRIEF SUMMARY OF THE INVENTION

The invention provides an improved weight exercise apparatus comprising an interlocking grip bar assembly and weight plate assembly that can be used to form dumbbells, barbells and similar types of weight exercise equipment.

Weight plates of the apparatus of the invention can be added and interlocked with previously attached weight plates using a simple insert and twist motion. Accordingly, the process of changing weights does not require the removal of any collars, clamps, or similar holding devices.

In addition, no protruding bar is exposed at the ends of the apparatus, and the outer faces of the weight plates are flat, making the assembly safe, easy to use, and aesthetically pleasing.

When weight plates are interlocked to each other on the grip bar assembly, the invention provides for minimal clearances between parts, limiting any "mechanical play" between weight plates and reducing any "rattle noise", typical of loose plates on a barbell.

One embodiment of the invention includes a spring or flexible material to further minimize movement between parts.

Each weight plate assembly of the invention includes a locking mechanism to provide safety from an accidental disconnect of a weight plate from the grip bar, or from an adjacent plate.

As a further safeguard against accidental disconnection, when weight plate assemblies are attached to each other, each plate covers the locking mechanism of the adjacent plate, preventing the locking mechanism from being deactivated. This feature of the invention also ensures that additional weights cannot be added to the assembly unless previously added weights are firmly locked in place.

The modular, interlocking, components of the invention can be fabricated by blending molded parts With metal parts, to make the assembly cost effective, attractive, and functional.

The novel interlocking features and safeguards of the invention are adaptable to exercise equipment, sporting goods, and to other types of apparatus where removable interlocking elements are required.

DETAILED DESCRIPTION OF THE INVENTION

Figure 1:
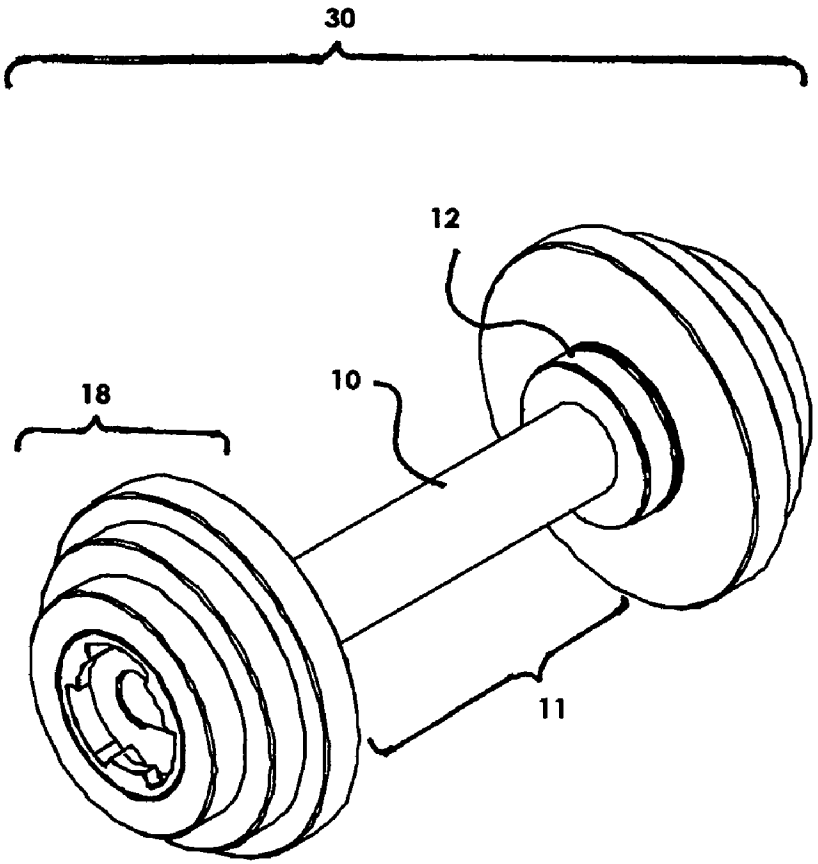
FIG. 1 is a perspective view of an apparatus of the invention.

With reference to FIG. 1, a weight exercise apparatus 30 of the invention comprises an interlocking grip bar assembly 11 and one or more weight plate assemblies 18.

The grip bar assembly 11 includes a bar or handle 10 having two ends, and a socket 12 at each end of the bar to which a weight plate assembly 18 may be attached.

In a preferred embodiment of the invention, the bar 10 of the grip bar assembly 111 is cylindrical in shape and of a convenient diameter to be easily grasped by hands.

Figure 2:
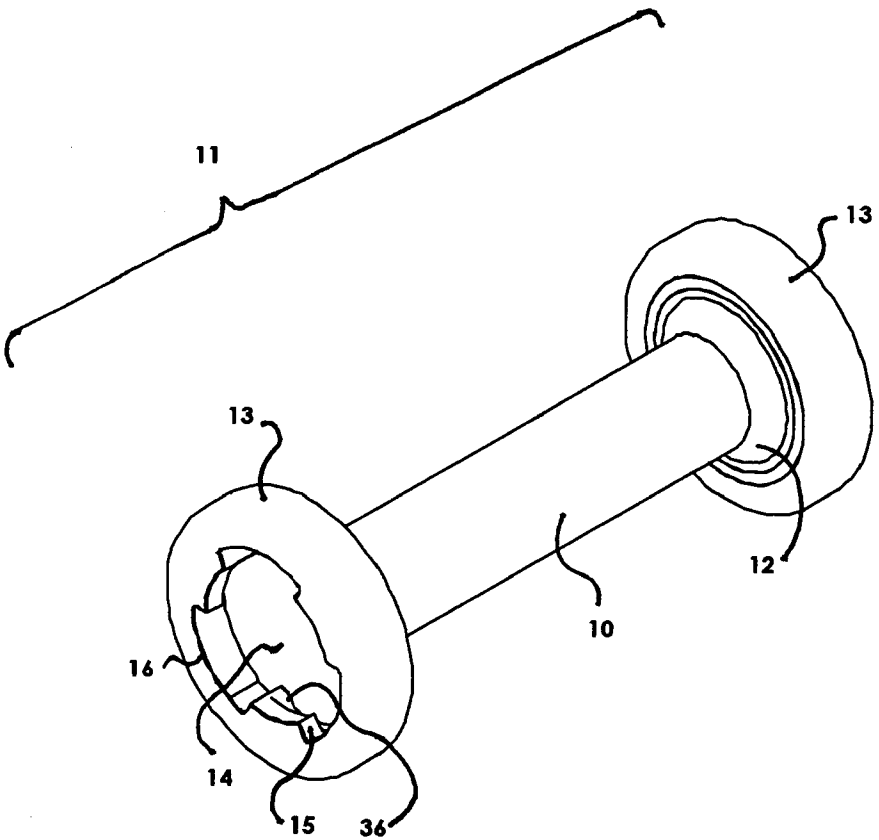
FIG. 2 is a perspective view of the grip bar assembly of the invention.

As shown in FIG. 2, each bar socket 12 comprises a housing 13 with a cylindrical cavity 14 having a bayonet-type flange 15 with two or more radially spaced cutouts 16 and one or more stop-position shoulders 36 configured to rotationally engage corresponding bayonet-type tabs of a weight plate assembly. Although a ring-shaped housing is shown, the housing may have other shapes including, but not limited to, square or rectangular formats.

Figure 3:
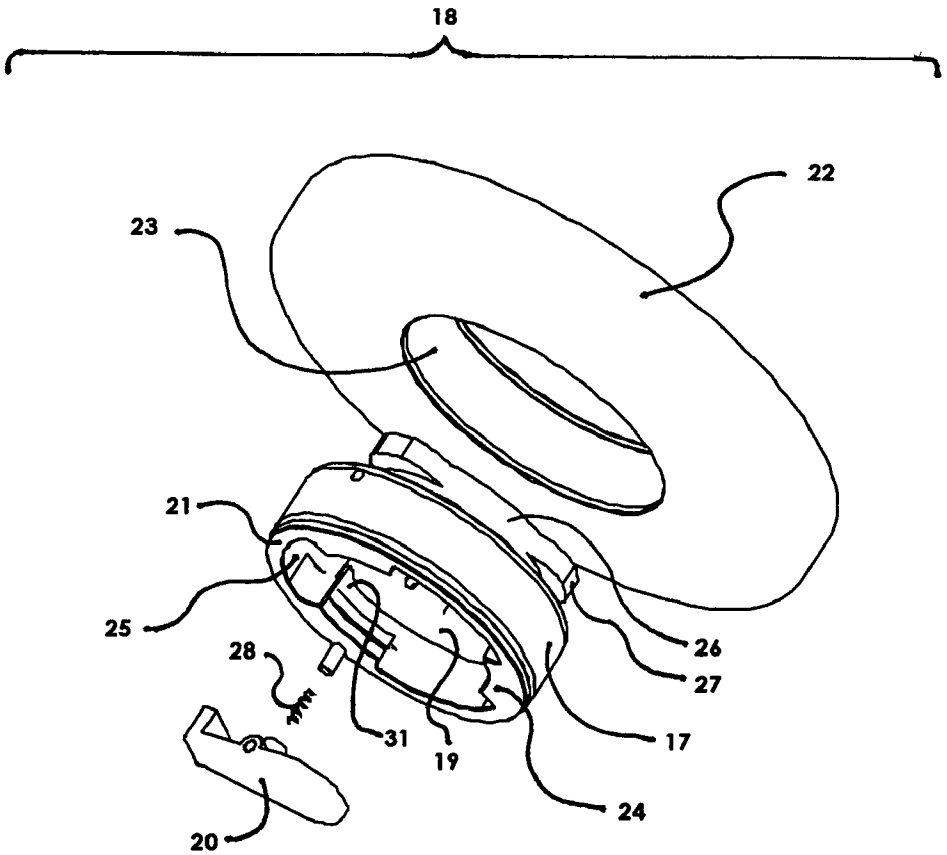
FIG. 3 is an expanded view of the weight plate assembly of the invention.

With reference to FIG. 3, each weight plate assembly 18 has a disc-shaped weight ring 22 with a central core 23, and an interlocking insert hub 17, adapted to fit into the core 23.

Although a disc-shaped weight ring is shown, a weight plate may have other shapes, including but not limited to square or rectangular formats, without detracting from the functionality of the invention.

The insert hub 17 of the weight plate assembly 18 is cylindrically shaped with a receiving receptacle 21 on one end and a mating connector 26 on the other end. The receiving receptacle 21 has an internal cavity 19 with a circular bayonet-type flange 24.

The flange 24 has two or more radially spaced cutouts 25, and one or more stop-position shoulders 31, adapted to rotationally engage a mating bayonet-type connector.

In a preferred embodiment of the invention, the flange 24 has three equally spaced cutouts.

The mating connector 26 of the insert hub 17 has two or more protruding bayonet-type tabs 27, adapted to be received by the cutouts 16 of the bar socket 12 of the grip bar assembly 11 of the invention, as shown in FIG. 2, or by the receiving receptacle of another weight plate assembly.

The receiving receptacle and the mating connector of the insert hub are designed so that a user may connect two weight plates or a grip bar and a weight plate quickly and easily.

When attaching weights to the grip bar assembly, the bayonet tabs of the insert hub of a weight plate assembly are inserted into the cutouts of the bar socket flange and rotated to a stop position shoulder in the socket cavity, creating an interlock so that the devices cannot be separated until a reverse rotation is applied.

The hub and bar socket of the invention are designed so that accurate alignment of the bayonet tabs of the hub and the socket flange cutouts is not necessary, making the assembly ergonomically friendly to normal hand and wrist movements.

Similarly, when adding additional weights to a weight plate assembly, the bayonet tabs of the insert hub of the added weight plate assembly are inserted into the flange cutouts of the receiving receptacle of the existing weight plate assembly and rotated to a stop position shoulder, creating an interlock, so that the weight plates cannot be separated until a reverse rotation is applied. This exemplary feature of the invention makes adding or removing weights a quick and easy process.

In order to ensure that weight plates cannot be disconnected accidentally, the invention further includes a locking mechanism to prevent an unintentional reverse rotation of a weight plate assembly.

In a preferred embodiment of the invention, the locking mechanism is actuated automatically when the insert hub of a weight plate assembly is rotated to the proper alignment in a receiving receptacle or socket. Alternatively, the locking mechanism can be adapted to be actuated manually.

Figure 4:
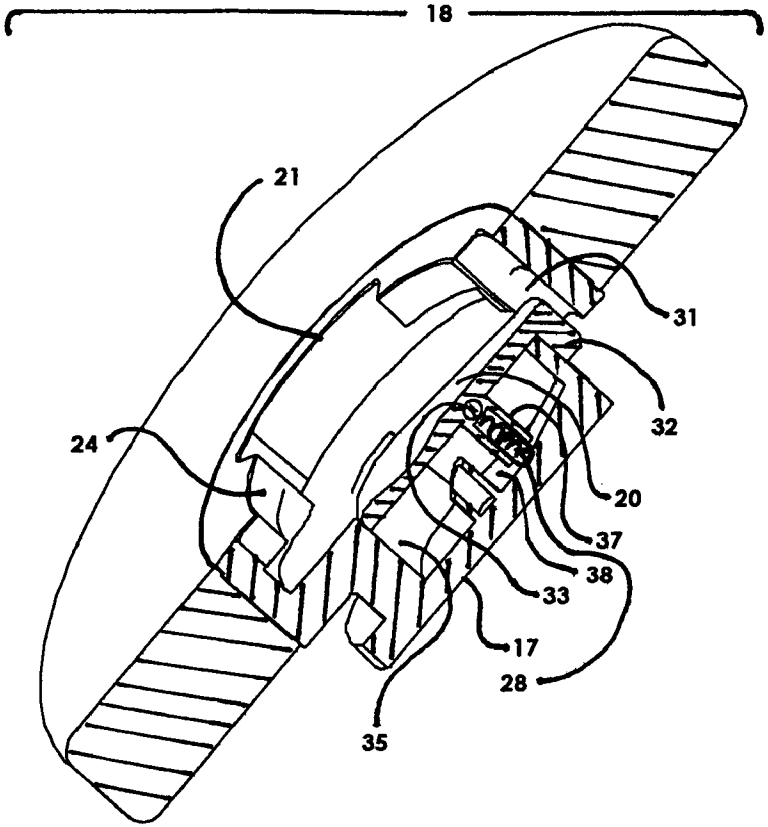
FIG. 4 is a sectional view of the insert hub of the invention.

With reference to FIG. 4, the receiving receptacle 21 of a weight plate assembly 18 includes a locking mechanism cavity 35 containing a locking lever 20. The lever is formed with an L-shaped extension 32 and a pin holder 37. A dowel 33 in said cavity 35 provides for rotational movement of the lever about the longitudinal axis of the dowel.

The pin holder is adapted to contain a movable spring-pin assembly 28 for engaging the bottom surface 38 of the locking mechanism cavity.

Figure 5:
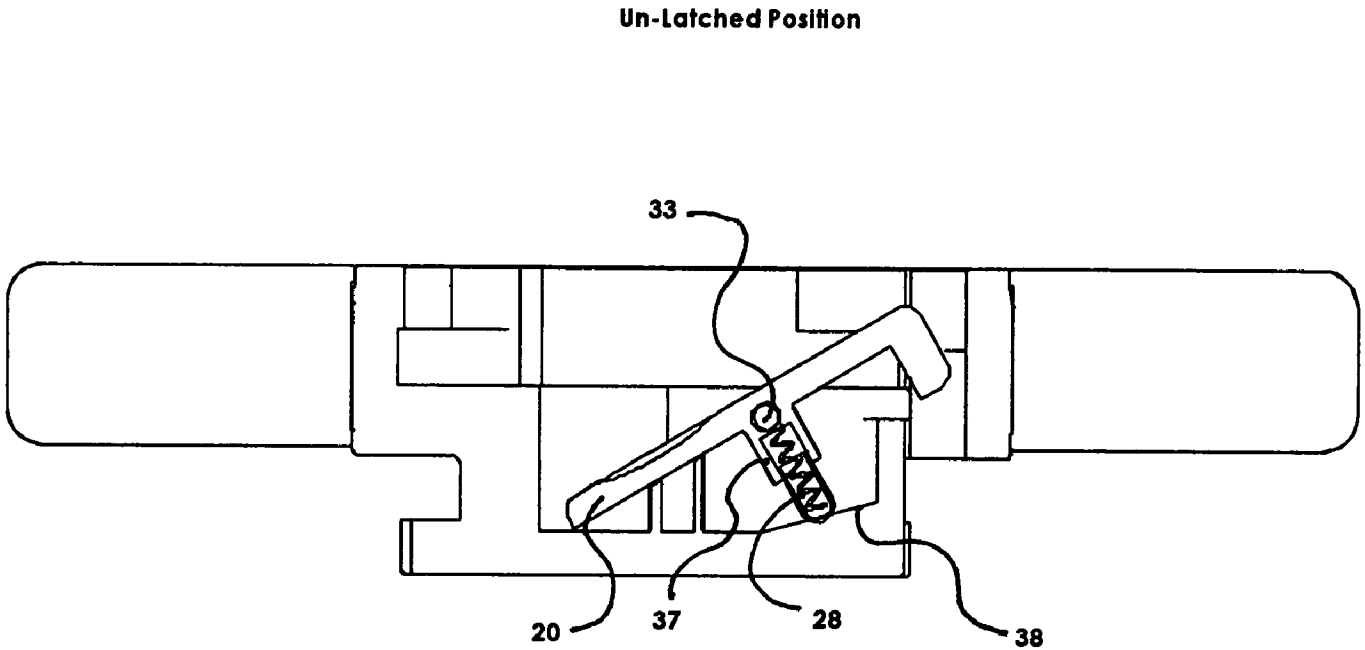
FIG. 5 is an illustrative view of the latching mechanism of the invention.

As shown illustratively in FIG. 5, the spring-pin assembly 28 exerts pressure on the bottom surface 38 of the cavity and on the locking lever 20. The bottom surface of the cavity is preferably ramp-shaped to keep the lever in a desired latched or unlatched position.

As shown in FIG. 4, the locking lever extension 32 protrudes outside the locking mechanism cavity to engage the flange shoulder of an interlocked weight plate assembly whenever the locking lever is in the latched position.

To release the locking mechanism, the locking lever is pushed by a finger or thumb to an unlatched position, to disengage the L-shaped extension from the attached weight plate. The plate can then be rotated in the reverse direction and released from the assembly.

Figure 6:
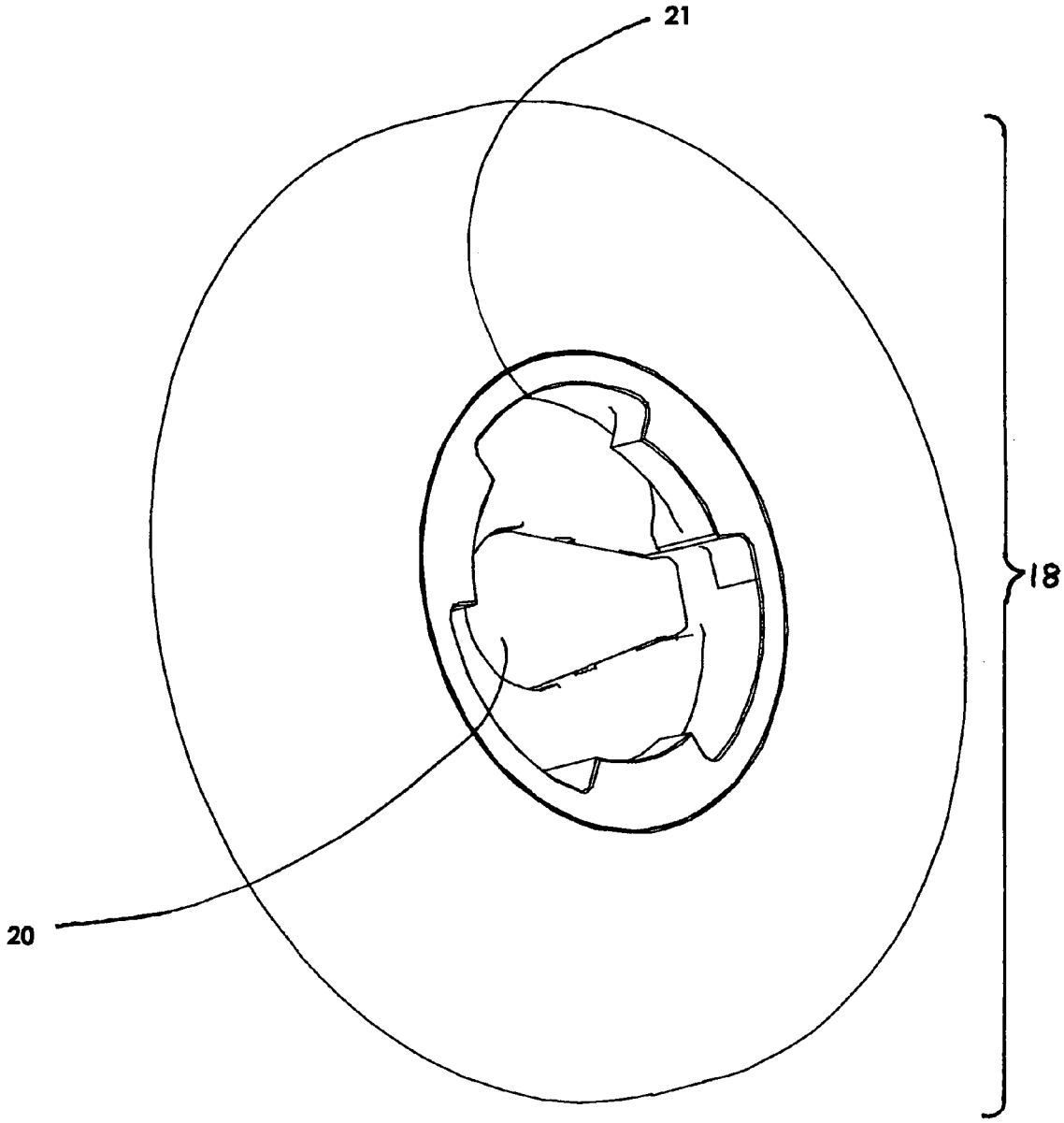
FIG. 6 is a perspective view of the weight plate assembly of the invention.

As shown in FIG. 6, in the latched position, the locking lever 20 is aligned with the locking mechanism cavity in the receiving receptacle 21 of the weight plate assembly 18, thereby permitting the hub of another weight plate assembly to be attached to the receiving receptacle.

Figure 7:
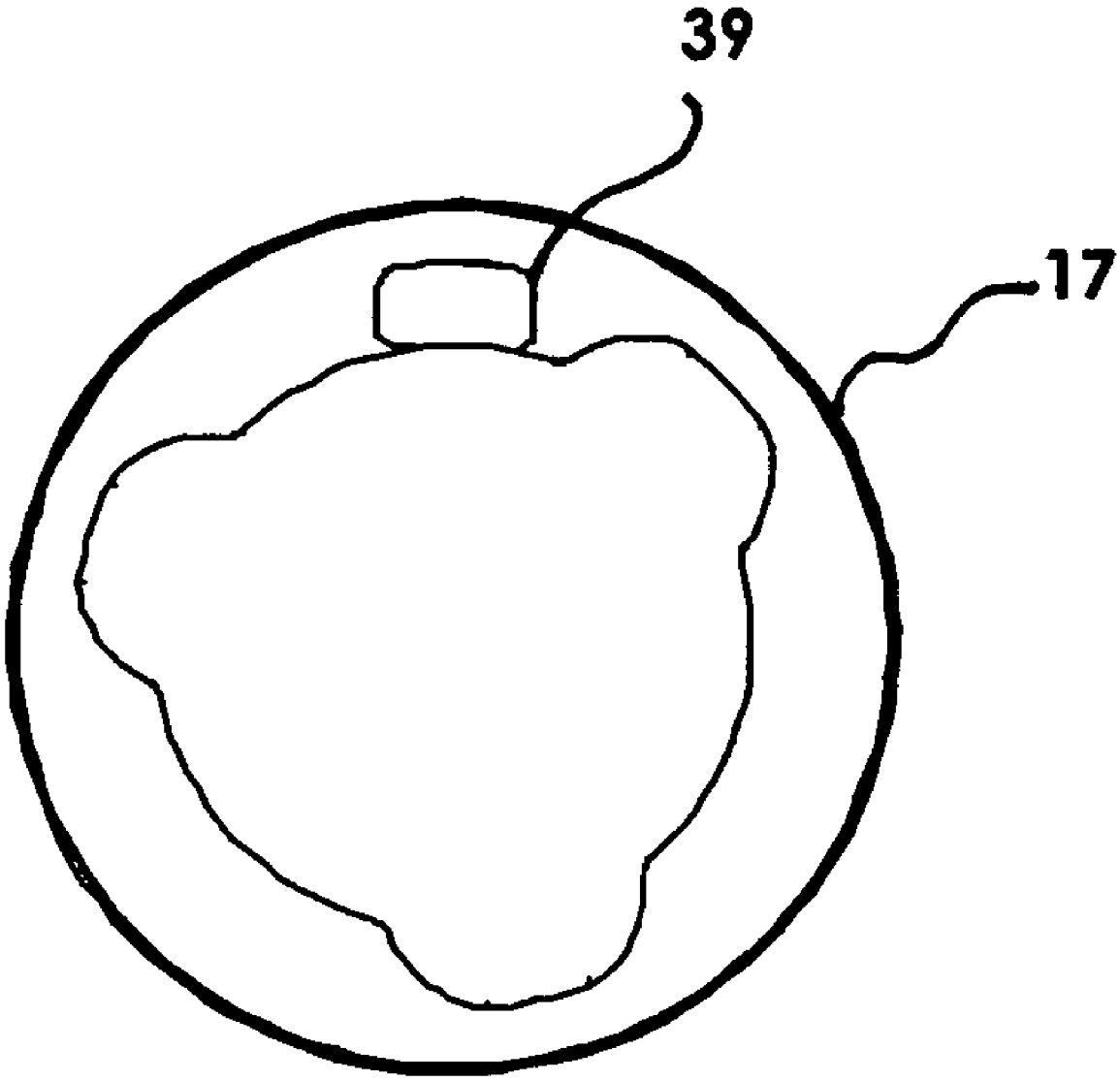
FIG. 7 is a view of the locking lever slot of the invention.

With reference to FIG. 7, the locking lever extension is adapted to protrude through a slot opening 39 in the hub 17 when in the latched position, and clears the slot opening when in the unlatched position.

In operation, to create an interlock between two weight plate assemblies, or between a weight plate assembly and the grip bar assembly of the invention, the bayonet tabs of the weight plate assembly to be attached are first inserted into the cutouts in the flange of the grip bar socket or receiving weight plate receptacle. The attached weight plate is then rotated to the stop position at the shoulder of the flange, creating an interlock. When the two assemblies are in proper alignment, the locking lever is depressed to prevent a reverse rotation of the attached weight plate, maintaining the interlock.

In a preferred embodiment of the invention, as illustrated in FIG. 4, the spring pin assembly 28 can be relocated to a pin holder 39 on the bottom surface 38 of the locking mechanism cavity 35, to provide automatic latching of the locking lever. In this configuration, the spring-pin assembly presses the locking lever extension into the latched position when the attached weight plate is interlocked with a receiving receptacle.

The interlocking elements of the invention can be formed with minimal clearances between parts to limit "mechanical play" and any "rattling noise" of the weight plates.

Figure 8:
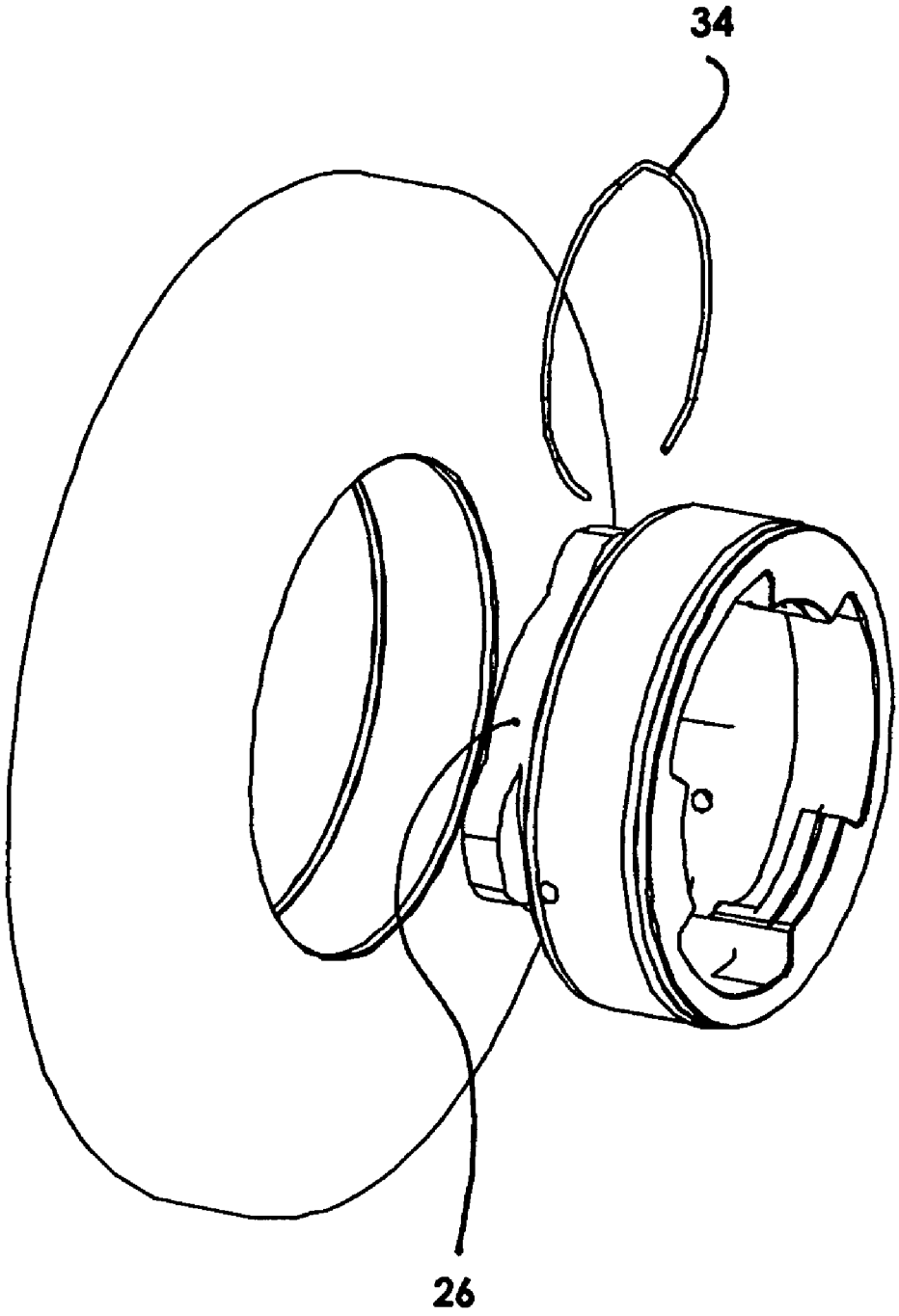
FIG. 8 is a perspective view of the compression spring feature of the invention.

As shown in FIG. 8, a circular compression spring 34 can be added to the insert hub connector 26 to further limit movement between interlocked weight plate assemblies.

The invention is designed to be ergonomically friendly. The grip bar does not extend beyond the attached weight plates and the apparatus can be manufactured with metal and molded parts, so that all surfaces are smooth and rounded, thereby avoiding injury to the body and preventing snagging of other objects.

Although the various features of novelty that characterize the invention have been described in terms of certain preferred embodiments, other embodiments will become apparent to those of ordinary skill in the art, in view of the disclosure herein. Accordingly, the present invention is not intended to be limited by the recitation of the preferred embodiments, but is instead intended to be defined solely by reference to the appended claims.

What is claimed is:

1. A weight apparatus, comprising:

a set of weight plates comprising at least a first weight plate and a second weight plate, each weight plate having a central hub having a first face and a second face;

the first face of the hub having a first interlocking formation;

the second face of the hub having a second mating formation for releasable mating engagement with the first mating formation of a second weight plate of said set;

the mating formations comprising first and second rotationally engageable, interlocking formations for selectively attaching a first weight plate to a second weight plate of said set; and each weight plate having a locking mechanism movable between a latched position and an unlatched position, the latched position preventing rotation of an interlocked second weight plate in an unlocking direction to release the interlocking formations;

whereby two or more weight plates may be releasably locked together to adjust the total weight for an exercise.

2. The system as claimed in claim 1, wherein the first mating formation comprises a socket and the second mating formation comprises a connector for releasable mating engagement in said socket, said socket having an annular, fixed flange, the flange having at least two cut-outs forming at least two spaced flange portions, and the connector having at least two radial locking tabs for engaging behind said flange portions in a locked position, said tabs being of predetermined dimensions for engaging through said cut outs when said connector is axially engaged in said socket, and engaging behind said flange projections to lock said connector in said socket in a locked position on rotation of said connector in a first direction relative to said socket.

3. The system as claimed in claim 2, wherein said socket has at least two stops for preventing relative rotation in said first direction beyond said locked position.

4. The system as claimed in claim 1, wherein each hub has a mounting cavity on said first face and said locking mechanism comprises a locking lever pivotally mounted in said cavity for movement between an inoperative position in which said plates are free to rotate in an unlocking direction and an operative position projecting partially outwardly for stopping relative rotation between said plates in said unlocking direction.

5. The apparatus as claimed in claim 4, wherein the second face of the hub of each weight plate has an opening communicating with said cavity, and said locking lever has a portion projecting through said opening in the latched position, whereby said portion is adapted to engage a co-operating portion of the mating formation of an interlocked weight plate when two weight plates are attached together to prevent unintentional rotation and separation of the plates.

6. The apparatus as claimed in claim 4, further comprising a biasing member in said cavity biasing said locking lever into the latched position.

7. The apparatus as claimed in claim 4, wherein said locking lever has a first end which projects partially outwardly in said latching position and a second end, the second end comprising an actuator button for depressing by a user to move the locking lever into the unlatched position and permit separation of the plates.

8. The apparatus as claimed in claim 1, wherein the first mating formation of each weight plate hub comprises a generally cylindrical socket and the second mating formation comprises a connector for engagement in said socket, the socket having a bayonet-type flange, said flange having at least two radially spaced cut-outs and one or more stop shoulders positioned to engage corresponding bayonet-type tabs on the connector of another weight plate to which the weight plate is attached.

9. The apparatus as claimed in claim 1, further comprising a bar for supporting one or more of said weight plates, the bar having an end having a mating formation thereon of shape and dimensions corresponding to one of said mating formations on the weight plates for selective mating engagement with the other of said mating formations of a selected weight plate.

10. The apparatus as claimed in claim 9, wherein the mating formation on the bar comprises a socket.

11. The apparatus as claimed in claim 1, wherein each weight plate further comprises an outer weight ring having a central opening, said central hub being secured in said opening.

12. A weight apparatus, comprising:

a bar having at least one end;

the end of the bar having a first interlocking formation for releasable rotational engagement with a mating, second interlocking formation;

a set of weight plates, each weight plate having an outer rim, a first face, and a second face opposite to the first face;

the first face having a first interlocking formation identical to the first interlocking formation at the end of said bar, and the second face having a second interlocking formation for releasable mating engagement with the first interlocking formation of said bar or the first face of another weight plate of said set whereby the weight plate is attached to said bar or to another weight plate;

each weight plate having a locking mechanism, said locking mechanism movable between an unlocked position and a locked position to prevent the unintentional rotation of the weight plate relative to the bar or another attached weight plate;

whereby two or more weight plates are selectively attachable together and one or more weight plates are selectively attachable to the end of said bar;

one of said interlocking formations comprises a central socket and the other of said interlocking formations comprises a central connector for releasable mating engagement in said socket; and said socket has a bayonet-type flange having at least two radially spaced cut-outs and said connector has at least two corresponding bayonet-type tabs positioned and dimensioned for engagement through said cut-outs when said connector is axially engaged in said socket and for engagement behind said tabs when said connector is rotated relative to said socket into a fully mated position.

13. The apparatus as claimed in claim 12, wherein said socket has at least two stop shoulders for engaging said tabs in said fully mated position to prevent further rotation of said connector relative to said socket.

14. The apparatus as claimed in claim 13, wherein each weight plate has a locking mechanism mounting cavity in said socket, said locking mechanism comprising a locking lever pivotably mounted in said cavity and movable between a latched position and an unlatched position, the opposite face of said weight plate having an opening communicating with said cavity, and said locking lever having a portion projecting through said opening in said latched position to engage a stop shoulder in the socket of an attached weight plate or bar end.

15. The apparatus as claimed in claim 14, wherein said locking mechanism further comprises a biasing member biasing said locking lever into the latched position.

16. The apparatus as claimed in claim 15, wherein said locking lever has a manual actuator for operation by a user to move said locking lever into the unlatched position, whereby the weight plate can be separated from an attached bar or other weight plate.

17. The apparatus as claimed in claim 16, wherein said manual actuator of the locking lever of an earlier mounted weight plate is inaccessible when a later mounted weight plate is attached to said earlier mounted weight plate.

18. The apparatus as claimed in claim 11, wherein each weight plate has a locking mechanism cavity, the locking mechanism comprising a lever pivotally mounted in said cavity for movement between a latched position and an unlatched position, said lever having a stop portion projecting outwardly for engagement with one of said interlocking formations of an attached weight plate or bar end to prevent relative rotation between said interlocking formations.

* * * * *